US007771236B2

(12) United States Patent
Koyama et al.

(10) Patent No.: US 7,771,236 B2
(45) Date of Patent: Aug. 10, 2010

(54) ELECTRICAL CONNECTOR

(75) Inventors: Ryozo Koyama, Tokyo (JP); Eiji Wakatsuki, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/635,013

(22) Filed: Dec. 7, 2006

(65) Prior Publication Data

US 2007/0141891 A1 Jun. 21, 2007

(30) Foreign Application Priority Data

Dec. 20, 2005 (JP) ..... 2005-366907

(51) Int. Cl.
*H01R 13/648* (2006.01)

(52) U.S. Cl. ..... 439/607.53

(58) Field of Classification Search ..... 439/328, 439/607, 610, 607.53, 607.51, 607.47
See application file for complete search history.

(56) References Cited

U.S. PATENT DOCUMENTS 4,959,626 A * 9/1990 Mouissie ..... 439/607.01
7,134,900 B2 * 11/2006 Chung ..... 439/353
2005/0245132 A1 * 11/2005 Huang et al. ..... 439/607

FOREIGN PATENT DOCUMENTS

| | | |
|---|---|---|
| JP | 2003-17176 | 1/2003 |
| JP | 2003-017176 A | 1/2003 |
| JP | 3111256 U | 6/2005 |

OTHER PUBLICATIONS

European Search Report, Apr. 4, 2007.

* cited by examiner

*Primary Examiner*—Felix O Figueroa
(74) *Attorney, Agent, or Firm*—Kubotera & Associates LLC

(57) ABSTRACT

An electrical connector includes: a housing having a terminal supporting member and a space at a base portion of the terminal supporting member; a plurality of terminals attached to the housing and arranged on the terminal supporting member in parallel; a latch member arranged on the terminal supporting member in parallel to the terminals for locking a mating connector; and a housing cover attached to the housing for covering a part of the housing. The housing cover includes a cylindrical portion for covering the terminal supporting member and a base portion held in the space.

17 Claims, 11 Drawing Sheets

ELECTRICAL CONNECTOR

BACKGROUND OF THE INVENTION AND RELATED ART STATEMENT

The present invention relates to an electrical connector. More specifically, the present invention relates to an electrical connector having a housing cover covering a terminal supporting member.

When an electrical connector is connected to a personal computer, a keyboard, a mouse, a printer, and the likes, for example, there may be a case in which the connector is twisted because an insertion direction of the connector is wrong, thereby applying an excessive force to the connector. In order to protect the connector from such force, in general, a housing cover made of metal covers a portion protruding toward a mating connector.

However, it is difficult to obtain enough strength by simply covering the portion protruding toward the mating connector. As a result, there is a problem in which a terminal is damaged due to twist and the likes. In order to solve such a problem, for example, as disclosed in Japanese Patent Publication No. 2003-17176, a part of a metal cover is situated in a space of a housing.

FIG. 19 shows a metal shell of a connector disclosed in the publication. In the conventional example, an upper half 113 of a base portion of a cylindrical portion 113 of the metal shell protrudes toward a housing. The upper half 113 thus protruded is inserted into a space of a housing (not shown), thereby increasing strength of the housing. However, it is still difficult to obtain enough strength by inserting only the upper half of the metal shell. Further, the connector is separately formed of a housing main body holding a terminal and a housing cover into which the metal shell is inserted, thereby increasing the number of the parts and a height of a fitting portion.

[Patent Reference 1] Japanese Patent Publication No. 2003-17176

In view of the problems described above, an object of the present invention is to provide an electrical connector, in which it is possible to sufficiently increase strength of, especially, a terminal supporting member protruding toward a mating connector with a metal shell, and to provide a lock on the terminal supporting member for locking the mating side of the connection.

Further objects will be apparent from the following description of the invention.

SUMMARY OF THE INVENTION

According to the present invention, an electrical connector includes a housing; a plurality of terminals to be attached to the housing in parallel; and a housing cover covering a part of the housing. The housing has a terminal supporting member protruding toward a mate side of connector where the plurality of the terminals and a latch member arranged in parallel to the plurality of the terminals and used for locking the mate side of the connection are arranged along the protruding direction. The housing cover has a cylindrical portion covering the terminal supporting member along the protruding direction. The housing has a space extending toward inside the housing in a direction opposite to the protruding direction at a base portion side of the terminal supporting member, so that a base portion of the cylindrical portion is held in the space of the housing when the cylindrical portion cover the terminal supporting member.

According to the present invention, in the electrical connector, the space of the housing may be disposed at least circumferences of thick wall portions extending at left and right sides of the terminal supporting member along the protruding direction. Further, in the electrical connector, the space of the housing may be disposed at least in one surface of the terminal supporting member opposite to the other surface where the plurality of the terminals is arranged.

According to the present invention, in the electrical connector, each of the plurality of the terminals may have a contact piece arranged on the other surface of the terminal supporting member along the protruding direction in a state that a substantially upper half thereof is exposed. The space of the housing may be disposed over a whole circumference except an upper front wall surface having terminal holes for exposing the contact pieces; a portion on the other surface of the terminal supporting member where the latch member is provided at a position sandwiching the plurality of the terminals from both sides; and a lower supporting column disposed at a side opposite to the other surface of the terminal supporting member.

According to the present invention, in the electrical connector, a slit opened at the base portion of the cylindrical portion and closed at a front portion thereof may be disposed in the cylindrical portion along the protruding direction.

According to the present invention, in the electrical connector, the terminal supporting member may be integrally formed as a part of the housing.

According to the present invention, in the electrical connector, the housing cover may have a first cover portion with the cylindrical portion and a second cover portion without the cylindrical portion.

According to the present invention, in the electrical connector, the housing cover may be formed through a punching out and bending one metal plate.

According to the present invention, in the electrical connector, the terminal supporting member may have a plate shape. Further, the cylindrical portion may have a protruded portion extending in a direction perpendicular to the protruding direction.

According to the present invention, with the electrical connector, it is possible to protect the housing with the metal shell having the lock and sufficient strength.

DETAILED DESCRIPTION OF PREFERRED EMBODIMENTS

Hereunder, embodiments of the present invention will be explained with reference to the accompanying drawings.

Figure 1:
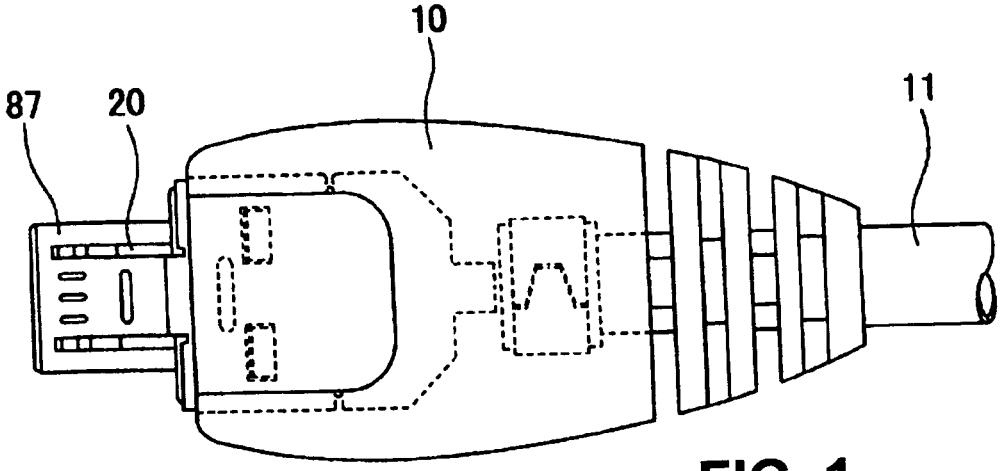
FIG. 1 is a plan view of an electrical connector according to an embodiment of the present invention.
Figure 2:
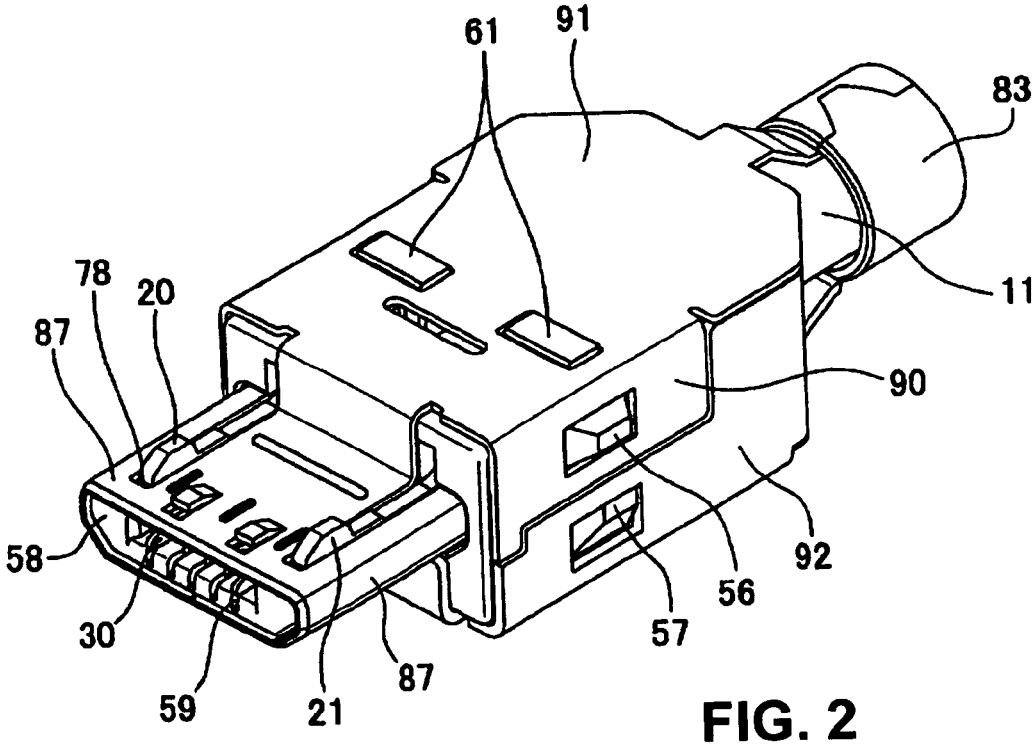
FIG. 2 is a perspective view of the electrical connector before over mold.
Figure 3:
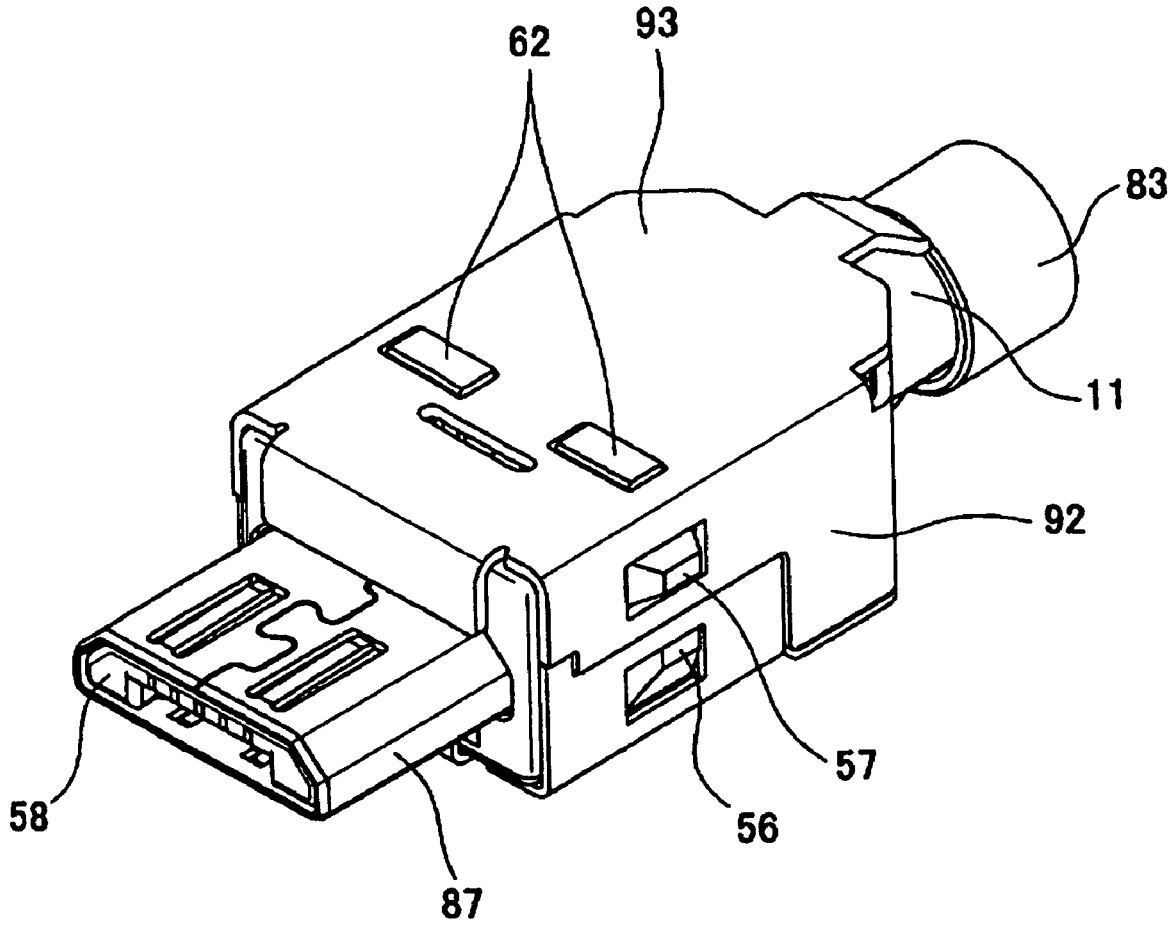
FIG. 3 is a perspective view of the electrical connector before over mold.
Figure 4:
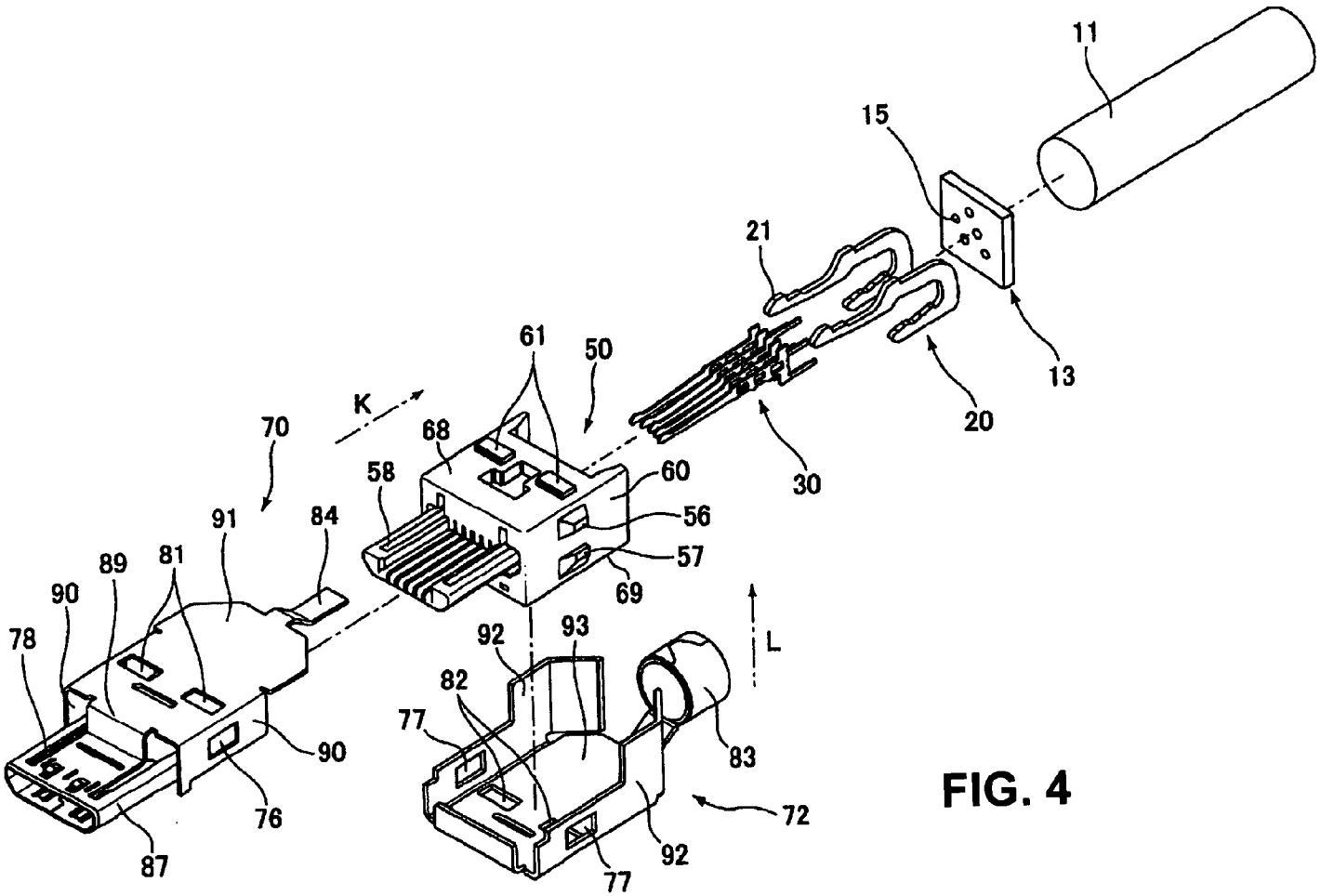
FIG. 4 is an exploded perspective view of the electrical connector before over mold.

In FIG. 1, a plane view of an electrical connector 1 according to the present invention is shown. In FIGS. 2 and 3, an upper perspective view and a lower perspective view of the electrical connector 1 before over mold are shown, respectively. Further, in FIG. 4, an exploded perspective view of the electrical connector 1 before over mold is shown.

As apparent from FIG. 18 (described later), the electrical connector 1 is used as a so-called plug side connector. In an actual use, the electrical connector 1 is detachably fitted into a receptacle side connector (mating connector) 2 disposed on a substrate 101.

The electrical connector 1 mainly includes a housing 50 integrally formed of a resin and the likes; a first shell 70 (first cover portion) and a second shell 72 (second cover portion) used as a cover of the housing 50; terminals 30 with a plate shape arranged in parallel in a longitudinal direction with a narrow pitch such as, for example, 0.4 mm interval; latch members 20 arranged in parallel together with the terminals 30 at positions sandwiching the terminals 30 from left and right sides for locking the electrical connector 1 and the receptacle side connector 2; and a print circuit board (PCB) 13 for covering a rear portion of the housing 50 to prevent the latch members 20 and the terminals 30 from coming off. Note that it is not necessary to provide the print circuit board 13.

The components other than the second shell 72 can be assembled mutually in a substantially straight arrangement direction indicated by an arrow K in the drawing. First, the terminals 30 and the latch members 20 are fitted into the housing 50. Then, lead fixing portions 39 of the terminals 30 pass through lead holes 15 of the print circuit board 13 to protrude from the print circuit board 13. Leads (not shown) of a cable 11 are fixed to the lead fixing portions 39 thus protruded with solder and the likes.

After the assembling operation, the first shell 70 is attached, and the second shell 72 is attached from an arrow direction L (when the second shell 72 is attached, a tight-fitting portion 83 is in an open state, not in a closed state (tube shape) shown in the drawing). Lastly, the tight-fitting portion 83 in the open state is tightly fitted to a circumference of the cable 11 together with a plate portion 84. Note that the print circuit board 13 is not necessarily provided as described above. When the print circuit board 13 is not used, the leads of the cable 11 are directly fixed to the lead fixing portions 39 of the terminals 30 with solder and the likes.

Figure 5:
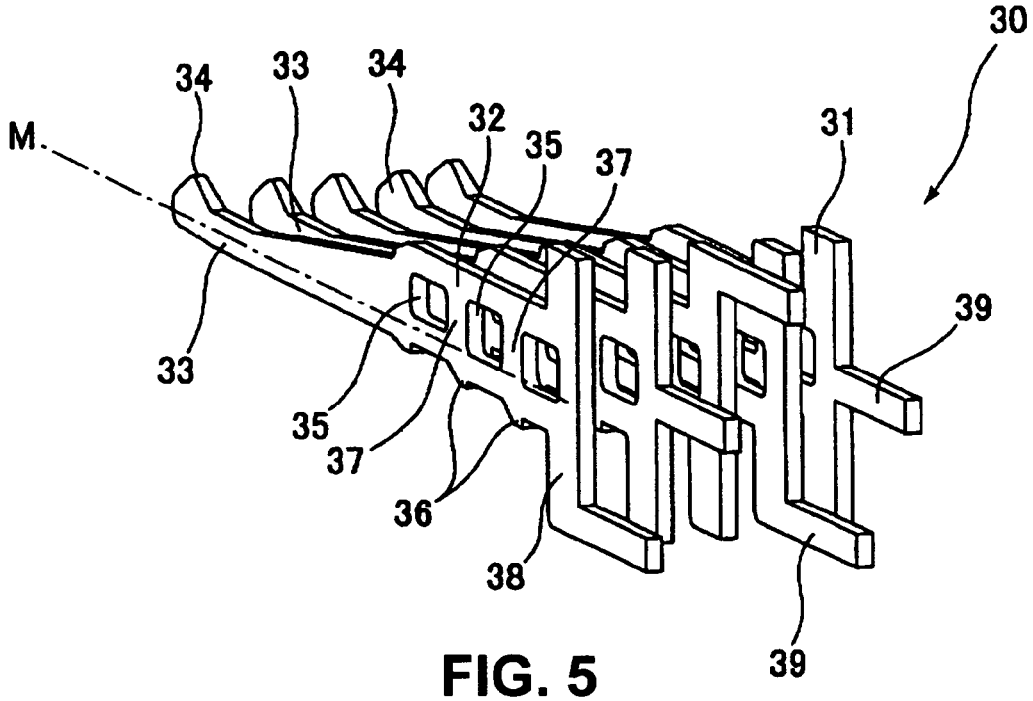
FIG. 5 is an enlarged perspective view of terminals arranged in a housing.

In FIG. 5, an enlarged perspective view of the arrangement state of the terminals 30 arranged inside the housing 50 is shown. Among the five terminals, for example, two terminals are provided for data communication, two terminals are provided for spare, and one terminal is provided for grounding. Total five of the terminals 30 are shown as an example, and the number thereof is not limited to a specific number. However, especially for the terminals for data communication, the terminals in an even number are preferable for achieving differential transmission. By using a pair of two terminals, plus noise and minus noise are canceled, and transmission characteristic can be maintained.

Each of the terminals 30 includes a connecting portion 31 as a rear half portion; a fixing portion 32 as a middle portion; and a contact piece 33 as a front half portion. All of the terminals 30 have the fixing portions 32 and the contact pieces 33 having a substantially same size and length, although a slight difference exists.

Each of the connecting portions 31 includes a vertical portion 38 extending in a direction perpendicular to a fitting direction; and the lead fixing portion 39 extending in a direction same as the fitting direction. The lead fixing portions 39 are arranged alternately up and down to increase a vertical distance between the adjacent lead fixing portions and prevent contact (electrical interference) therebetween.

The contact pieces 33 have a pointed shape tapered toward the fitting direction. Contact portions 34 facing upward are provided at distal ends of the contact pieces 33. When the electrical connector 1 is fitted into the receptacle side connector 2 (refer to FIG. 18), the contact portions 34 can contact with contact portions of receptacle side corresponding terminals 102. One contact portion 34 is provided on one terminal. Accordingly, the contact portions 34 function as a so-called one point contact terminal. Especially, the contact piece 33 of each of the terminals 30 has elasticity to be freely movable up and down, so that the contact with the receptor side corresponding terminals 102 becomes smooth and secure. The contact pieces 33 are held in a state of lifting slightly from the housing 50 (a thin wall portion 47 of a terminal supporting member 58).

Each of the fixing portions 32 has a plurality (three in the embodiment) of holes 35 arranged in a substantially one row along an attaching direction of the terminals 30 to the housing 50 at a substantially center portion thereof. The holes 35 are formed in opposing portions of adjacent terminals, so that it is possible to reduce opposing areas between the terminals 30 and capacitance to be generated there between.

By reducing capacitance, it is easy to obtain impedance compatibility and reduce cross talk between the terminals. It is preferred that the holes 35 of each of the terminals 30 are arranged at same positions in the pitch direction to provide large opposing areas between the adjacent terminals as possible.

As indicated by a projected line M in FIG. 5, it is preferred that the contact portions 34 are arranged along the arrangement direction of the plurality of the holes 35 at a height position same as the arrangement position of the holes 35. By arranging the contact portions 34 at such positions, it is expected that the contact portions 34 have greater elasticity due to elasticity generated by the holes 35.

A size of the holes 35 is preferably large from the viewpoint of reducing cross talk. In an actual case, from the viewpoint of an elongated shape of the fixing portions 32, and strength and processability of the terminal, the size is limited. When the plurality of the holes 35 is formed, it is preferred to provide columns 38 between the holes. When the terminals 30 are fitted into the housing 50, a large force is applied to fitting protrusions 36 used for fitting. Accordingly, as shown in FIG. 5, it is preferred to provide the fitting protrusions 36 near base portions of the columns 37 with large strength.

Figure 6:
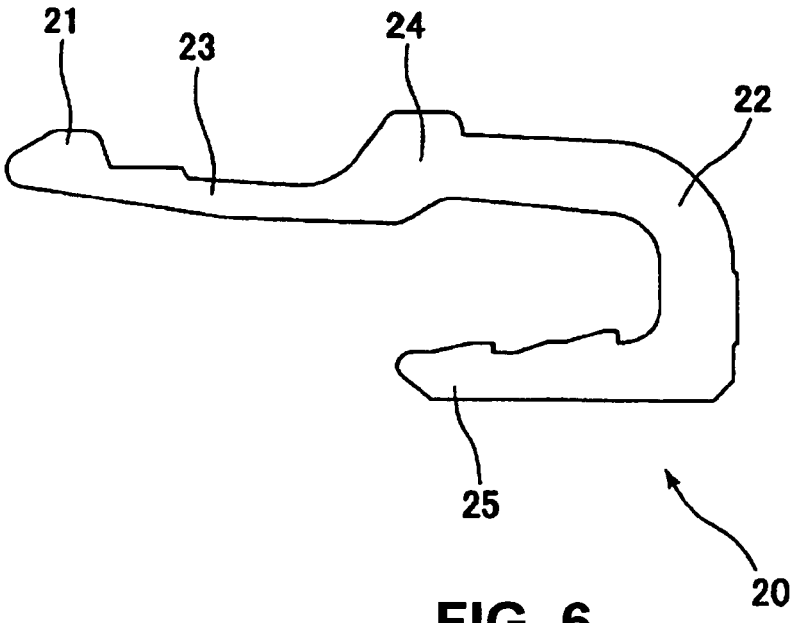
FIG. 6 is a side view of a latch member.

In FIG. 6, a side view of the latch members 20 is shown. Each of the latch members 20 includes a U shaped portion 22 as a main portion at a rear portion thereof; and a front extended portion 23 as a forward extended portion of an upper portion of the U shape. A fitting supporting portion 24 is provided between the front extended portion 23 and the U shaped portion 22 to be fitted into the housing 50 together with a corresponding portion 25 of the U shaped portion 22. A lock piece 21 is provided at a distal end of the front extended portion 23 to be elastically movable up and down through an operation of the U shaped portion 22.

Figure 7:
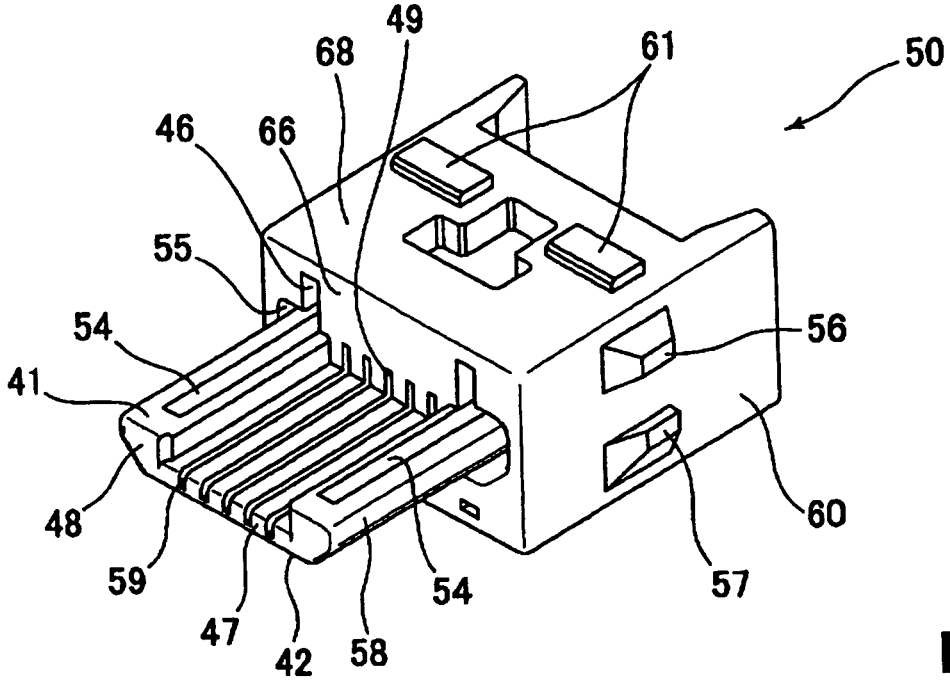
FIG. 7 is a perspective view of the housing.
Figure 8:
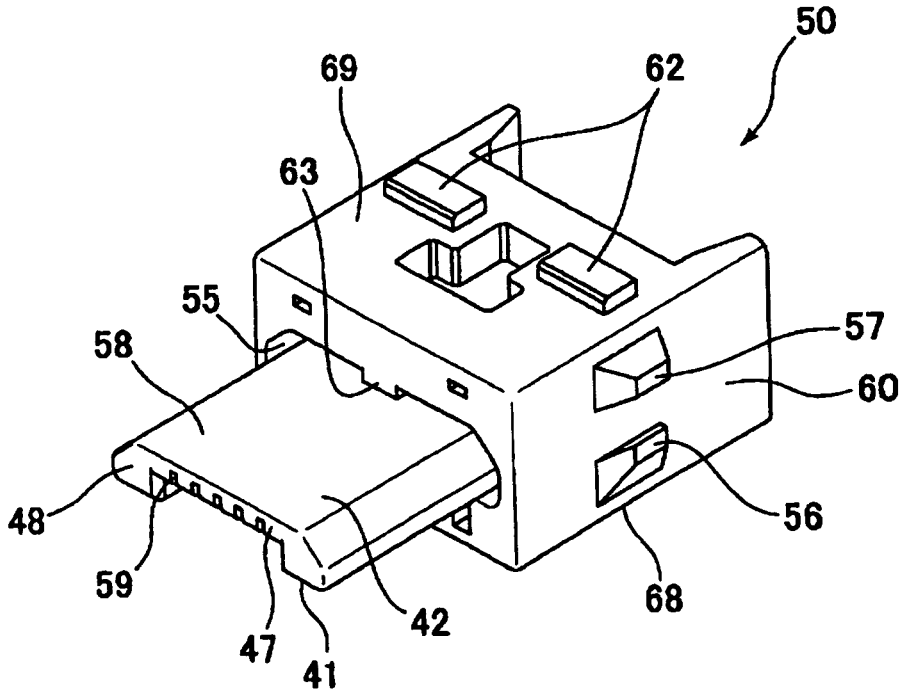
FIG. 8 is a perspective view of the housing.
Figure 9:
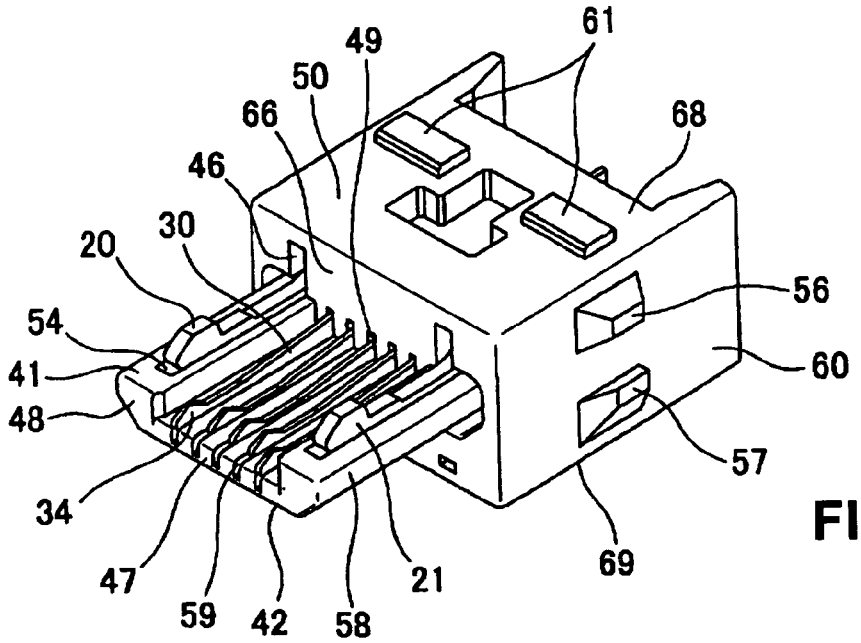
FIG. 9 is a view of the housing shown in FIG. 7 with the latch members and the terminals arranged therein.
Figure 10:
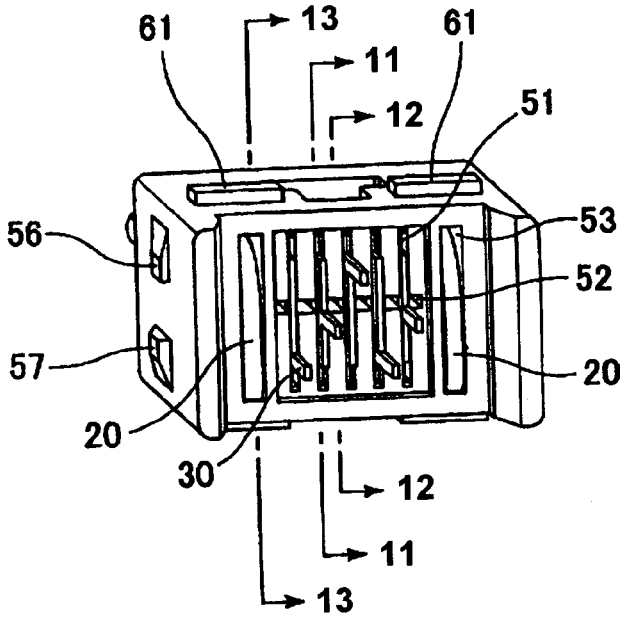
FIG. 10 is a perspective view of the housing.
Figure 11:
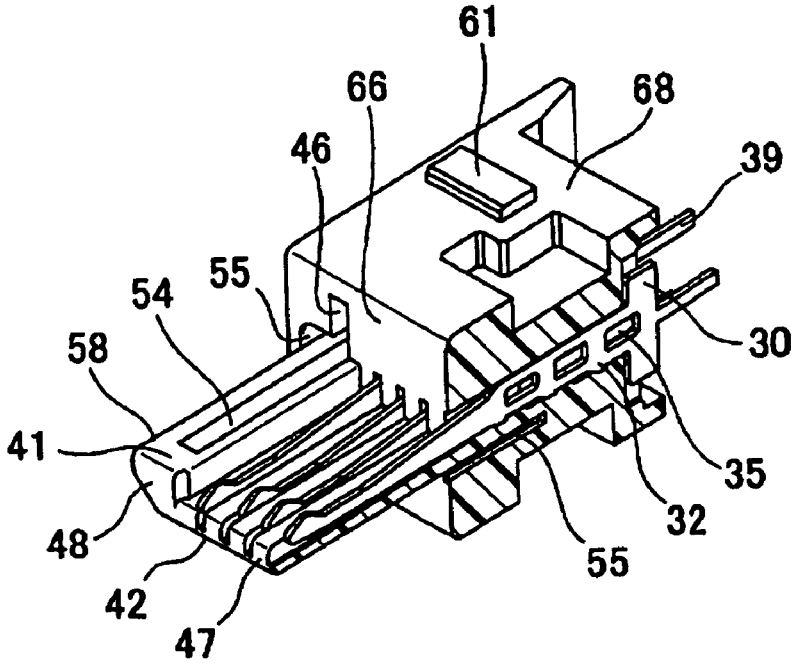
FIG. 11 is a sectional perspective view of the housing taken along a line 11-11 in FIG. 10.
Figure 12:
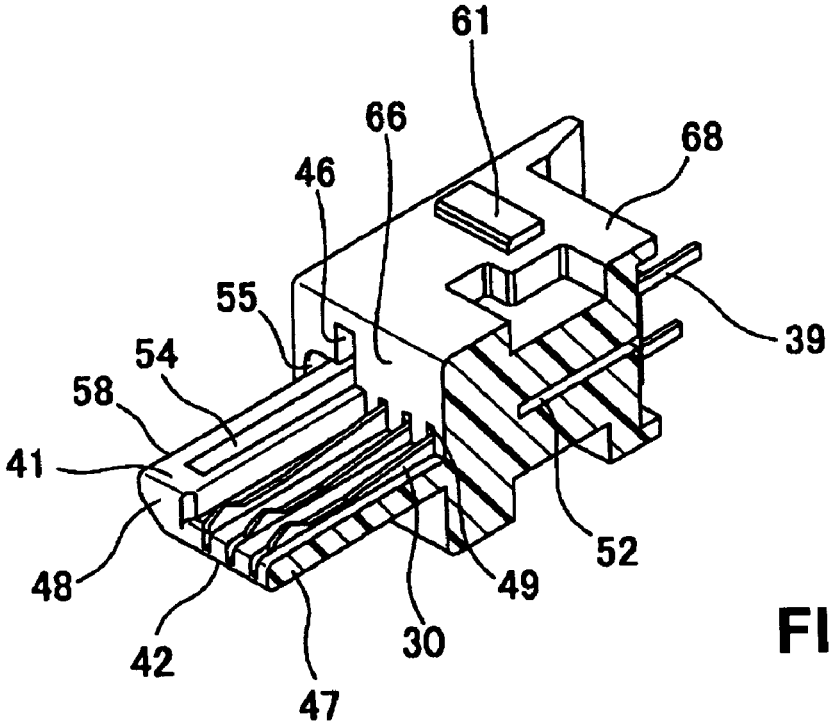
FIG. 12 is a sectional perspective view of the housing taken along a line 12-12 in FIG. 10.
Figure 13:
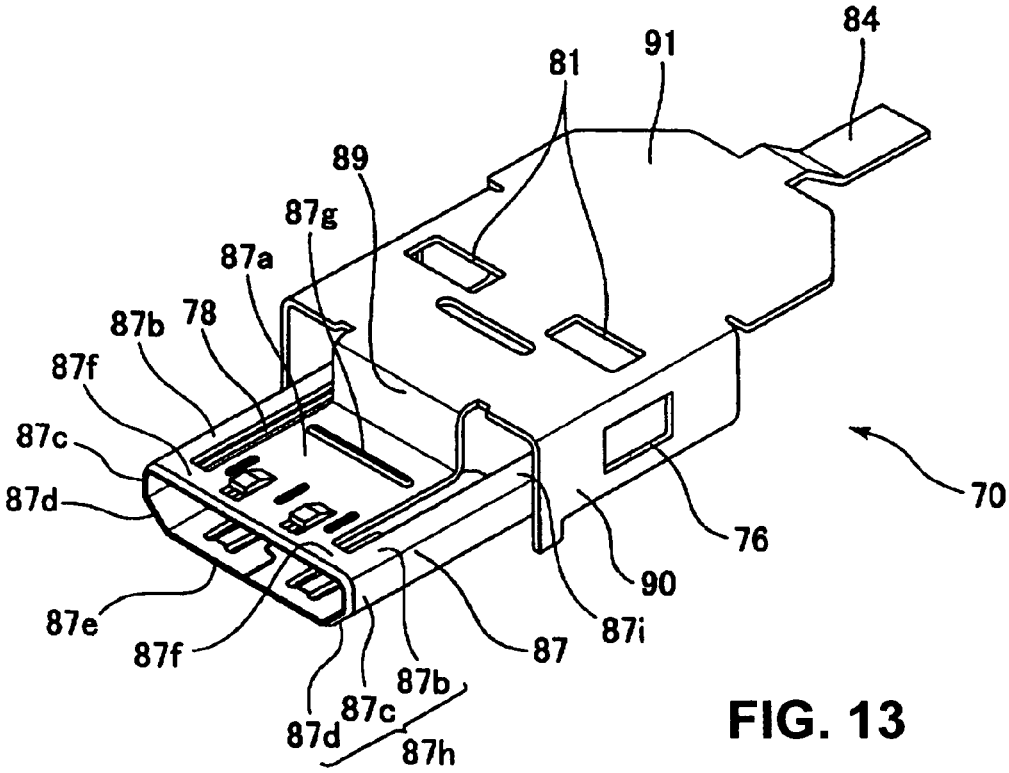
FIG. 13 is a sectional view of the housing taken along line 13-13 in FIG. 10.

A configuration of the housing 50 will be explained with reference to FIGS. 7 to 13. FIG. 7 is an upper appearance perspective view of the housing 50. FIG. 8 is a lower appearance perspective view thereof. FIG. 9 is a view showing the housing 50 shown in FIG. 7 with the latch members 20 and the terminals 30 arranged therein. FIG. 10 is a backside perspective view of FIG. 9. FIGS. 11 to 13 are a sectional perspective view taken along a line 11-11; a sectional perspective view taken along a line 12-12; and a sectional view taken along a line 13-13 in FIG. 10, respectively.

The housing 50 has the terminal supporting member 58 with a plate shape extending toward the mating connector at a distal end thereof. A space 55 is formed at a base portion of the terminal supporting member 58, and extends toward inside the housing 50 opposite to the extending direction of the terminal supporting member 58. The space 55 is used for holding a part of a base portion of the first shell 70 attached to the housing 50 to increase strength of the terminal supporting member 58.

The space 55 is provided over a whole circumference except an upper front wall surface 66 of the housing 50; portions (46) where the latch members 20 are provided; and a supporting column 63 (refer to FIG. 8) provided at a position opposite to one surface of the terminal supporting member 58 where the latch members 20 and the terminals 30 are provided.

However, the position where the space 55 is provided is not limited thereto. For example, the space 55 may be provided only around circumferences of thick wall portions 48 extending on left and right sides of the terminal supporting member 58 along the extending direction (or opposite direction) of the terminal supporting member 58. Further, the space 55 may be provided in a surface 42 opposite to one surface 41 of the terminal supporting member 58 where the terminals 30 are provided.

Since the space 55 holds a part of the first shell 70, it is possible to increase an area of the terminal supporting member 58 covered with the first shell 70 and increase strength of the terminal supporting member 58. Accordingly, it is possible to reduce a risk of damaging the terminal supporting member 58 due to twist generated upon inserting into and pulling out relative to the mating connector.

The terminals 30 and the latch members 20 are fitted into the housing 50 through vertical holes 51 and vertical holes 53 of the housing 50, respectively. At this time, the contact pieces 33 of the terminals 30 are elastically held along terminal grooves 59 of the thin wall portion 47 of the terminal supporting member 58 in a state that upper half portions of the contact pieces 33 and the contact portions 34 are exposed through terminal holes 49 communicating with the vertical holes 51.

Similarly, the latch members 20 are elastically held along grooves 54 formed in the thick wall portions 48 of the terminal supporting member 58 in a state that substantially upper half portions of the front extended portion 23 and the lock pieces 21 are exposed through lock holes 46 communicating with the vertical holes 53. When fitted into the receptacle side connector (refer to FIG. 18), the latch members 20 engage corresponding latch portions of the mating connector using the lock pieces 21 capable of elastic deformation, so that the electrical connector 1 can be locked with the mating connector.

As shown in the sections in FIGS. 11 and 12, a lateral groove 52 is formed to bridge over the plurality of the terminals 30 near positions of the housing 50 where the fixing portions 32 of the terminals 30 are arranged for forming spaces between the adjacent terminals 30. By providing the lateral groove 52, it is possible to reduce dielectric constant between the adjacent terminals and reduce cross talk between the terminals. By providing the space 52 at a height position same as that of the holes 35 in the pitch direction, it is possible to effectively reduce cross talk.

It is preferred that the lateral groove 52 is made large as possible for reducing cross talk. However, in an actual case, it is necessary to determine the size according to strength and processability of the terminals.

Figure 14:
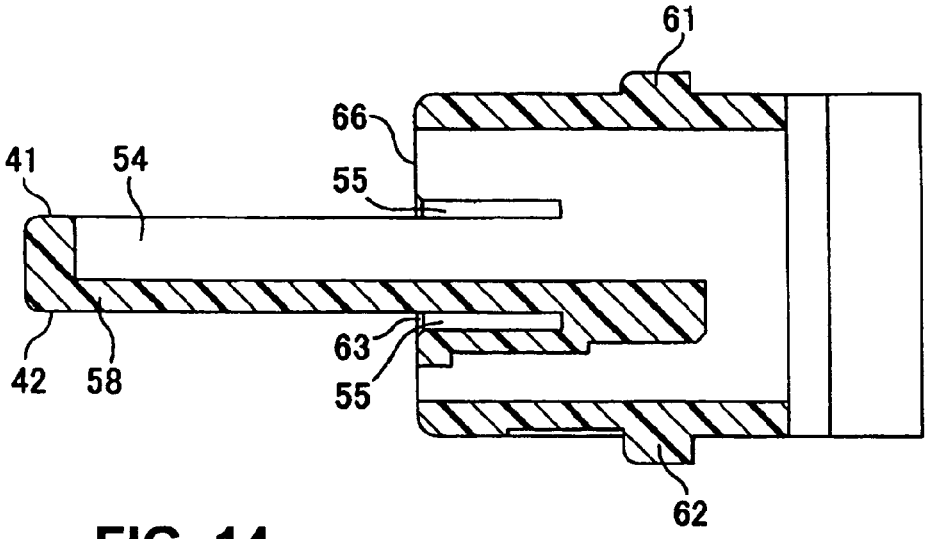
FIG. 14 is a perspective view of a first shell.
Figure 15:
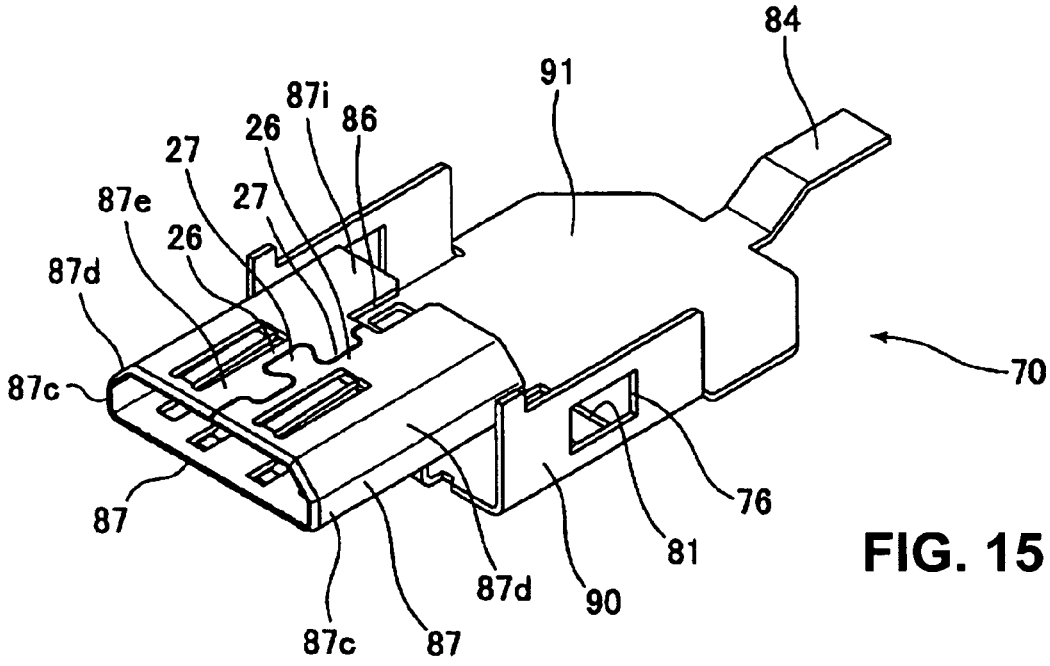
FIG. 15 is a perspective view of the first shell.
Figure 16:
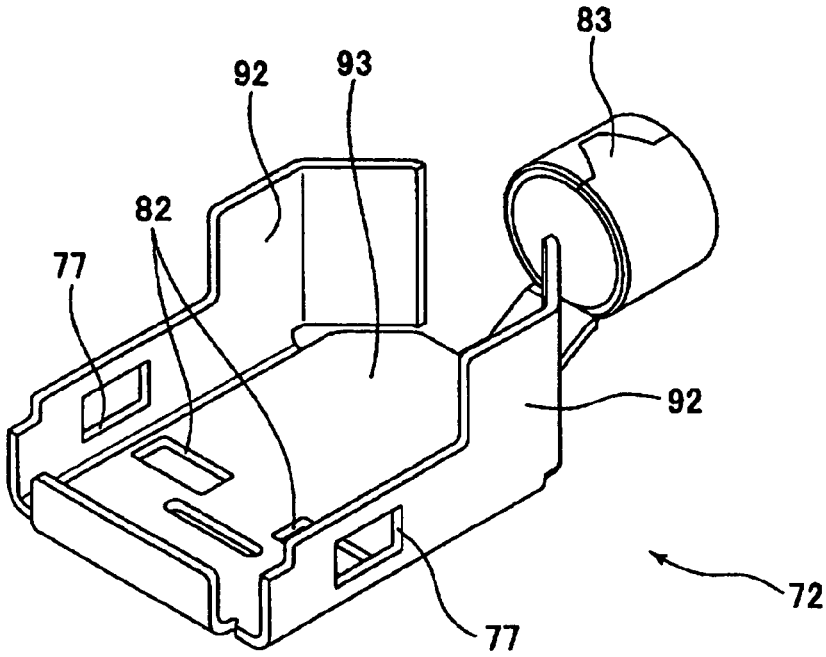
FIG. 16 is a perspective view of a second shell.
Figure 17:
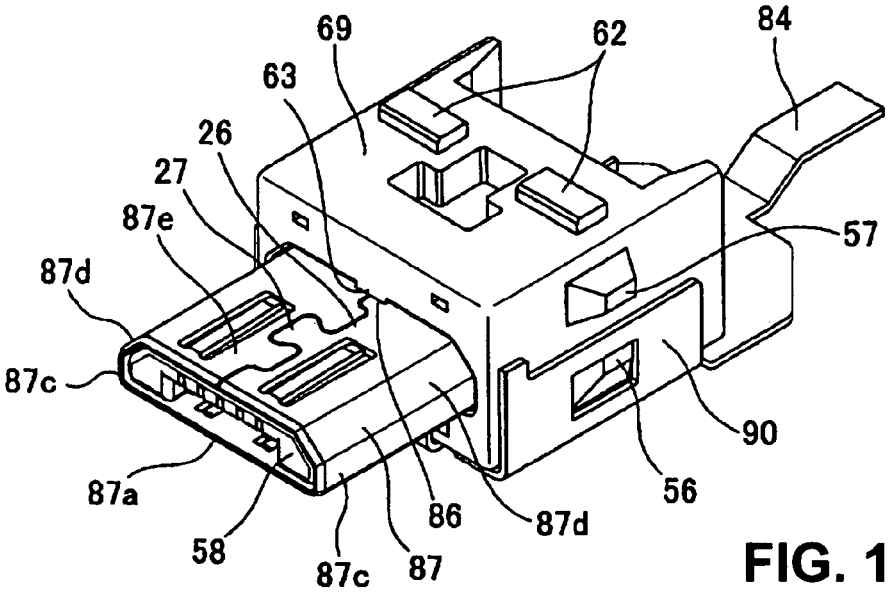
FIG. 17 is a view of the first shell attached to the housing.

Configurations of the first shell 70 and the second shell 72 will be explained with reference to FIGS. 14 to 17. FIG. 14 is an upper surface perspective view of the first shell 70, and FIG. 15 is a rear surface perspective view thereof. FIG. 16 is an upper surface perspective view of the second shell 72. FIG. 17 is a view showing a state that the first shell 70 is attached to the housing 50.

The first shell 70 can be formed through punching through and bending one thin metal plate. Accordingly, it is easy to produce the first shell 70. The first shell 70 mainly includes a cylindrical portion 87 for covering the terminal supporting member 58 along the extending direction thereof; a bent portion 89 for covering an upper front wall surface 66 of the housing 50 from front; an upper wall 91 for covering the upper surface 68 of the housing 50; and sidewalls 90 for covering an upper half of side surfaces 60 of the housing 50.

The cylindrical portion 87 is connected to the upper wall 91 through the bent portion 89, and is formed in a cylindrical shape through a recess portion 26 engaging a protruding portion 27 at a lower flat portion 87*e*. Further, the cylindrical portion 87 is provided with slits 78 opened at a base portion 87*i* of the cylindrical portion 87 and closed at a front connecting portion 87*f* for allowing the latch members 20 to be disposed. That is, the cylindrical portion 87 includes an upper flat portion 87*a* connected to the bent portion 89 and sandwiched by a pair of the slits 78; curved portions 87*h* connected through the connecting portion 87*f*; and a lower flat portion 87*e* facing the upper flat portion 87*a* and in parallel to the upper flat portion 87*a*.

Further, the curved portions 87*h* includes upper curved portions 87*b* situated outside the slits 78 around the thick wall portions 48 of the housing 50 and substantially flush with the upper flat portion 87*a*; side curved portions 87*c* as side surfaces of the cylindrical portion 87; and lower curved portions 87*d*. Accordingly, the curved portions 87*h* are formed of the three surfaces and have a substantially C shape section.

As shown in FIG. 14, the upper flat portion 87*a* is provided with a protruding portion 87*g*. With the protruding portion 87*g*, strength of the cylindrical portion 87 is increased, and it is possible to confirm the fitting state when the connector 1 is fitted into the receptacle side connector 2. The lower flat portion 87*e* is provided with a cut portion 86 for avoiding collision with the supporting column 63 of the housing 50 when the first shell 70 is attached to the housing 50 (refer to FIGS. 15 and 17).

When the first shell 70 is attached to the housing 50, the base portion 87*i* of the cylindrical portion 87 is inserted into the space 55 of the housing 50 and held there. In the embodiment, the base portion 87*i* to be inserted into the space 55 of the housing 50 is disposed on the curved portions 87*h* and the lower flat portion 87*e* of the cylindrical portion 87 corresponding to the space 55.

With the configuration described above, the base portion 87*i* of the cylindrical portion 87 is sandwiched and held with the space 55 of the housing 50. Accordingly, the first shell 70 is securely fixed to the housing 50. Further, it is possible to improve durability against twisting force when the connector is twisted.

In the connector according to the embodiment, the cylindrical portion 87 is provided with the slits 78, and the upper flat portion 87*a* and the curved portions 87*h* are connected through the connecting portion 87*f*. Accordingly, twist resistance at the curved portions 87*h* and the lower flat portion 87*e* (the slits may be expanded due to twist) may be decreased. However, since the base portion 87*i* of the cylindrical portion 87 is sandwiched and held with the space 55, the embodiment having the slits 78 has resistance against twist.

In particular, the curved portions 87*h* of the cylindrical portion 87 are arranged to surround the circumference along the outer curve of the thick wall portions 48 of the housing 50 (supporting the protruding terminal supporting member 58 from both sides), and the base portion 87*i* of the cylindrical portion 87 is sandwiched and held with the space 55. Accordingly, it is possible to withstand twist from any directions.

Further, the lower flat portion 87*e* facing the upper flat portion 87*a* of the cylindrical portion 87 where the lock pieces 21 of the latch members 20 is sandwiched and held with the space 55 of the housing 50. Accordingly, when reaction force from the latch members 20 is applied to the terminal supporting member 58 upon inserting and pulling out the connector, it is possible to withstand the force.

When the first shell 70 is attached to the housing 50, engaging holes 76 formed in the sidewalls 90 engage engaging protrusions 56 formed on the side surfaces 60 of the housing 50, and an engaging hole 81 formed in the upper wall 91 engages an engaging protrusion 61 formed on the upper surface 68 of the housing 50. Accordingly, the first shell 70 engages the housing 50. At this time, the cylindrical portion 87 of the first shell 70 covers around the circumference of the terminal supporting member 58.

Similar to the first shell 70, the second shell 72 also can be formed through punching through and bending one thin metal plate. A circular portion 83 is provided at a rear end of the second shell 72 for holding the cable. A main body portion of the second shell 72 has a shape corresponding to that of the first shell 70. When the first shell 70 and the second shell 72 are assembled together, they cover the terminal supporting member 58 and the side surface circumferences and the rear end side of the housing 50.

When the second shell 72 is attached to the housing 50, engaging holes 77 formed in the sidewalls 90 engage engaging protrusions 57 formed on the side surfaces 60 of the housing 50, and an engaging hole 82 formed in the bottom wall 93 engages an engaging protrusion 62 formed on the bottom surface 69 of the housing 50. Accordingly, the second shell 72 engages the housing 50.

Figure 18:
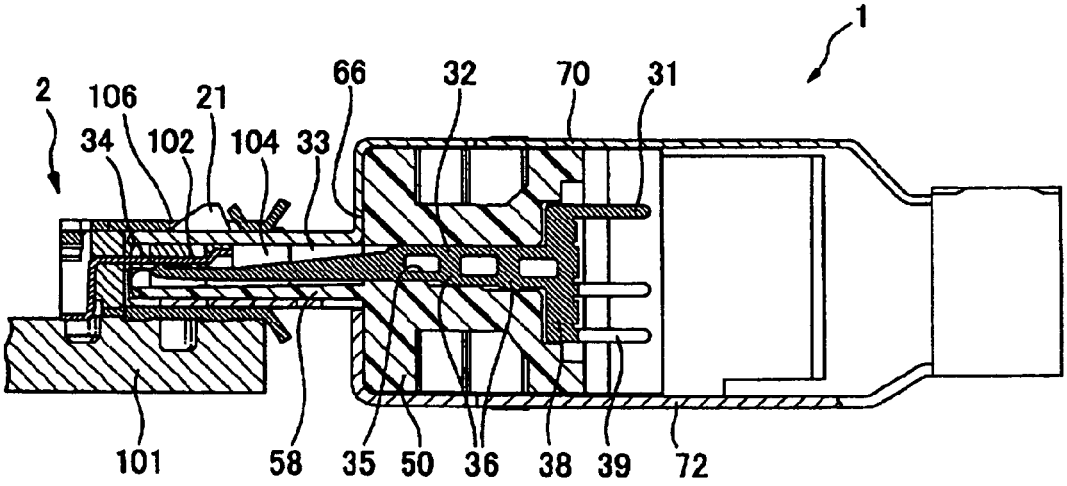
FIG. 18 is a sectional view of the electrical connector in a state connected to a receptacle side connector.
Figure 19:
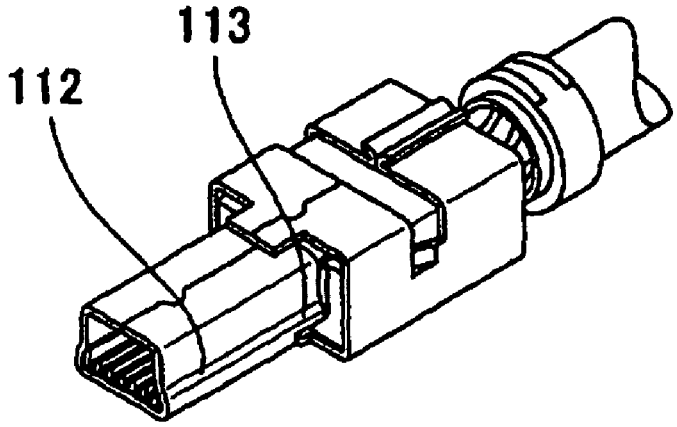
FIG. 19 PRIOR ART
FIG. 19 is a view of a conventional electrical connector.

FIG. 18 shows a connection state of the electrical connector (plug side connector) 1 of the present invention and the receptacle side connector. The receptacle side connector 2 may be fixed to, for example, an edge of the substrate 101. When the distal end of the terminal supporting member 58 covered around with the first shell 70 of the electrical connector 1 as the plug side connector is inserted into a insertion portion 104 of the receptacle side connector 2, the contact portions 34 on the side of the electrical connector 1 contact with contact pieces 102 on the side of the receptacle side connector 2. Also, the lock pieces 21 on the side of the electrical connector 1 engage engaging holes 106 on the side of the receptacle side connector 2, thereby locking the electrical connector 1 to the receptacle side connector 2.

INDUSTRIAL APPLICABILITY

The electrical connector of the present invention is widely applicable to small electronic and electrical devices.

The disclosure of Japanese Patent Application No. 2005-366907, filed on Dec. 20, 2005, is incorporated in the application.

While the invention has been explained with reference to the specific embodiments of the invention, the explanation is illustrative and the invention is limited only by the appended claims.

What is claimed is:

1. An electrical connector comprising:

a housing having a main portion and a terminal supporting member extending from the main portion toward a front end, said terminal supporting member having a first surface and a second surface opposite to the first surface;

an engaging protrusion protruding outwardly from the housing;

a plurality of terminals attached to the housing and arranged on the first surface of the terminal supporting member in parallel;

a supporting column protruding inwardly from the housing toward the second surface so that a space is formed inside the housing on both sides of the supporting column;

a latch member arranged on the terminal supporting member in parallel to the terminals for locking a mating connector; and a housing cover attached to the housing for covering a part of the housing, said housing cover including a cylindrical portion for covering the terminal supporting member, a housing main cover for covering the main portion, and a bent portion connecting the cylindrical portion and the housing main cover, said cylindrical portion including a base portion extending toward a rear end opposite to the front end beyond the bent portion so that the base portion is held in the space, said housing cover further including a cut portion for accommodating the supporting column and an engaging hole for accommodating the engaging protrusion.

2. The electrical connector according to claim 1, wherein said terminal supporting member extends in a first direction toward the mating connector, said terminals and said latch member being arranged along the first direction.

3. The electrical connector according to claim 2, wherein said cylindrical portion includes a slit opened at the base portion of the cylindrical portion and closed at a front portion thereof, said slit extending along the first direction.

4. The electrical connector according to claim 2, wherein said cylindrical portion includes a protruding portion extending in a direction perpendicular to the first direction.

5. The electrical connector according to claim 1, wherein said housing includes the space extending toward inside the housing.

6. The electrical connector according to claim 2, wherein said housing further includes thick wall portions extending at left and right sides of the terminal supporting member along the first direction so that the space surrounds at least circumferences of the thick wall portions.

7. The electrical connector according to claim 1, wherein said terminal supporting member includes one surface facing the space and another surface opposite to the one surface with the terminals arranged thereon.

8. The electrical connector according to claim 1, wherein each of said terminals includes a contact piece arranged on the terminal supporting member in a state that a substantially upper half thereof is exposed.

9. The electrical connector according to claim 8, wherein said housing further includes an upper surface having terminal holes for exposing the contact pieces; a latch receiving portion for receiving the latch member; and a lower supporting column so that the space surrounds a whole circumference of the housing except the upper surface, the latch receiving portion, and the lower supporting column.

10. The electrical connector according to claim 1, wherein said terminal supporting member is integrated with the housing.

11. The electrical connector according to claim 1, wherein said housing cover further includes a first cover portion having the cylindrical portion and a second cover portion separate from the first cover portion.

12. The electrical connector according to claim 1, wherein said housing cover is formed of one metal plate punched out and bent.

13. The electrical connector according to claim 1, wherein said terminal supporting member has a plate shape.

14. The electrical connector according to claim 1, wherein said space surrounds three sides of said terminal supporting member, including a side opposite a side where said plurality of terminals are provided.

15. The electrical connector according to claim 1, wherein said space surrounds a circumference of said terminal supporting member except where:

a front wall of said housing;

said latch member; and a terminal supporting member supporting column are disposed.

16. The electrical connector according to claim 1, wherein said supporting column is located at a side of said terminal supporting member opposite a side where said plurality of terminals are provided.

17. The electrical connector according to claim 1, wherein said supporting column protrudes by a specific height so that the space has a height equal to or greater than the specific height.

* * * * *